United States Patent [19]

Roosli

[11] 3,965,586

[45] June 29, 1976

[54] SKI BOOT COVER

[76] Inventor: Friedrich Roosli, 315 E. 77th St., New York, N.Y. 10021

[22] Filed: July 28, 1975

[21] Appl. No.: 599,608

[52] U.S. Cl. ..... 36/7.3; 36/122

[51] Int. Cl.[2] ..... A43B 1/10

[58] Field of Search ..... 36/2.5 R, 2.5 AL, 2.5 A, 36/7.1, 7.3

[56] References Cited

UNITED STATES PATENTS 2,032,052 2/1936 Friedenberg ..... 36/7.3

3,858,336 1/1975 Brown ..... 36/7.3

*Primary Examiner*—Patrick D. Lawson

*Attorney, Agent, or Firm*—John P. Snyder

[57] ABSTRACT

A ski boot sole covering assembly is specifically shaped to cover and protect all of the sole surfaces of a ski boot so as to be worn when the skis are not attached, thereby to preserve the integrity of the ski binding-engaging surfaces of the boot. The assembly also embodies a sole portion which is thickest in the area intermediate the toe and heel so as to allow a rocking action when walking.

7 Claims, 5 Drawing Figures

FIG. 1
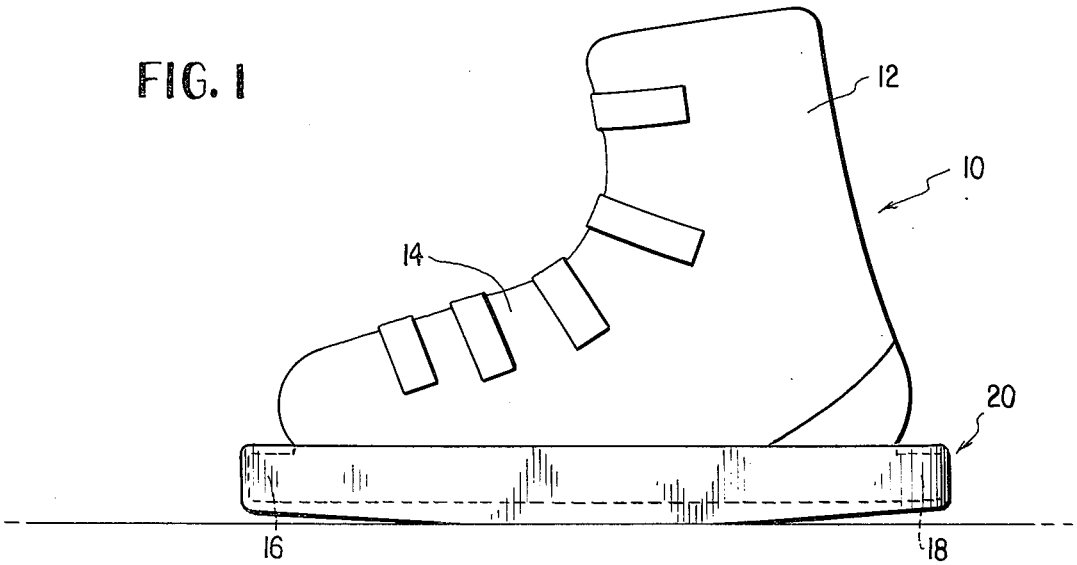
FIG. 2
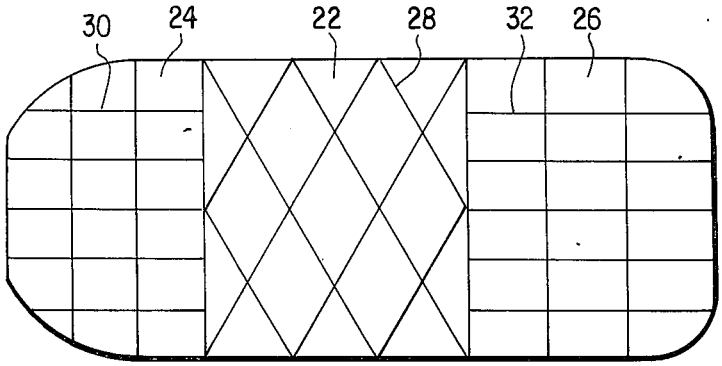
FIG. 3
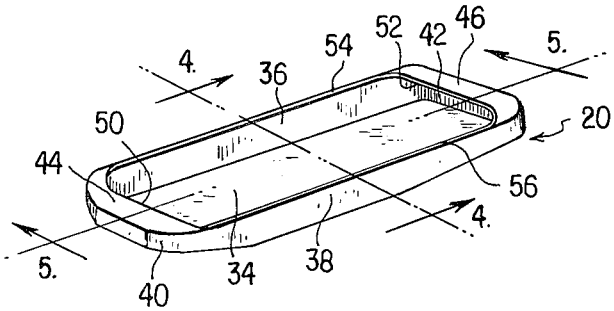
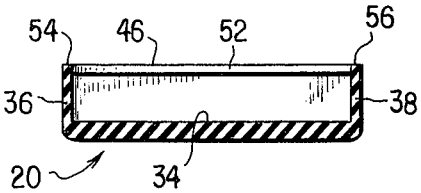
FIG. 4
FIG. 5
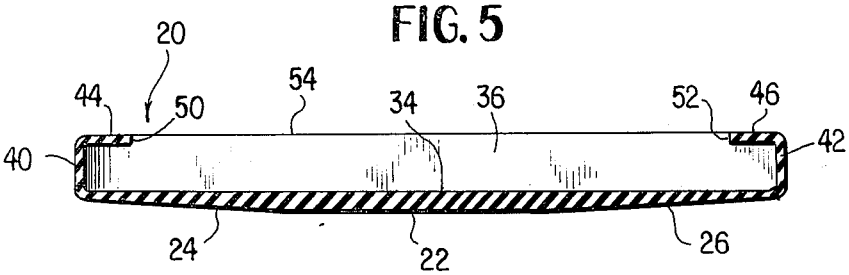

SKI BOOT COVER

BACKGROUND OF THE INVENTION

Contemporarily, ski boots are expensive items of equipment and are specially formed in order to provide the maximum protection for the user. In this regard, the sole surfaces of the boot are constructed as to engage with the ski and binding with a predetermined amount of friction so that efficient and rapid release of the boot from the ski and binding will take place under proper condition so as to maximize user safety. If the ski boots are used for normal walking to and fro they tend to accumulate and pick up snow, dirt, ice and other foreign material which not only may make it difficult for the boot properly to fit into the ski binding, but which also may give rise to scratching or scuffing of the sole areas of the ski boot plus modifying its intended anti-frictional characteristic which allows for the proper and rapid release of the boot from the binding under abnormal conditions. This same intended anti-frictional characteristic of the bottom of the ski boot sole also makes normal walking with the ski boot rather treacherous.

BRIEF SUMMARY OF THE INVENTION

Accordingly, it is of primary concern in connection with the present invention to provide a ski boot sole cover assembly which may be readily slipped on and taken off when the user desires to walk with the ski boots without the skis attached thereto. The cover assemblies according to the invention are made of elastic material and are of small size and insignificant weight so that they may be readily carried about by the user for use at all times when necessary.

Specifically, the ski boot sole cover assemblies of the invention include sole portions which are shaped essentially to the plan view area of the ski boot sole and which have upstanding opposite side walls and upstanding opposite end walls. The opposite end walls have covering flange portions which are adapted to engage easily over the toe and heel projections of the ski boot sole whereas the opposite side walls lie snugly against the sides of the ski boot sole which are flush with the uppers thereof as is extant in modern ski boot design.

The cover assembly effectively provides a collar which snugly engages at the juncture between the ski boot upper and the sole region thereof so as to provide maximum protection of the sensitive areas of the ski boot while at the same time being easily engaged and disengaged therefrom. Additionally, the sole portion of the assembly is thickest intermediate the heel and toe portions thereof and the heel and toe portions taper diminishingly towards the toe and heel so that a natural rocking action may occur when the cover assemblies are worn whereby to compensate somewhat for the extreme rigidity of the ankle portion of a normal ski boot. Further, the under surfaces of the sole portions of the assemblies are provided with gripping tread patterns.

BRIEF DESCRIPTION OF THE DRAWING FIGURES

FIG. 1 is a side elevational view of a conventional ski boot having the protector assembly of this invention associated therewith;

FIG. 2 is a bottom plan view of the assembly shown in FIG. 1;

FIG. 3 is a perspective view of an embodiment of the invention;

FIG. 4 is a transverse section taken substantially along the plane of section line IV—IV of FIG. 3; and FIG. 5 is a longitudinal section taken substantially along the plane of section line V—V in FIG. 3.

DETAILED DESCRIPTION OF THE INVENTION

The ski boot 10 illustrated in FIG. 1 is of contemporary design and includes the ankle section 12 and the upper section 14 which are so related and designed as to accommodate a user's foot and ankle and maintain them in proper orientation for proper skiing. As is conventional, the sole portion of the ski boot which joins with the bottom of the upper section 14 is essentially flush therewith along the opposite sides of the ski boot but the ski boot sole has toe and heel projections 16 and 18 which cooperate with the bindings removably and detachably to connect the ski boot to a ski, as is well understood by those skilled in the art. The bottom surface of the ski boot sole is flat so as to engage upon the binding plate and the sole in general is of relatively low frictional characteristics so as to allow proper relative movement between the boot and ski during, for example, a fall so that the binding may rapidly and efficiently release the boot and minimize the possibility of injury to the skier.

The slip-on cover assembly according to the invention is indicated generally by the reference character 20 in FIG. 1 and, as will be seen from FIG. 2, includes a sole portion whose size and shape conforms generally to the size and shape of the sole of the ski boot, including an intermediate section 22 which is of rectangular form and is of substantially uniform thickness throughout, and the toe and heel sections 24 and 26. The bottom surface of the protector assembly is provided with gripping tread patterns 28, 30 and 32, as is shown in FIG. 2 and, as is represented in FIG. 5, the toe and heel sections 24 and 26 are of gradually diminishing thickness tapering from the intermediate section 22 towards the heel and toe ends of the assembly. This permits a natural rocking action, as will be evident from FIG. 1, when the protector assembly is worn on the ski boot and the boots are used in normal walking.

As is seen in FIG. 3, the sole member is provided with a flat upper surface 34 so as to engage in face-to-face contact with the bottom of the sole and at either side thereof there are provided the integrally formed upstanding side wall members 36 and 38. Similarly, the toe and heel ends of the sole portion are provided with the upstanding end walls 40 and 42 and it will be seen that the side walls 36 and 38 integrally join opposite sides of the end walls 40 and 42 to define, in general, a boat-like assembly as is clearly illustrated in FIG. 3.

Covering flanges 44 and 46 are provided at the toe and heel ends respectively of the assembly 20 and these cover flanges extend between the side walls 36 and 38 along the upper edges of the end walls 40 and 42 and are so shaped along their inner edges 50 and 52 so as to cooperate with the upper edges 54 and 56 of the side walls 36 and 38 as effectively to form a collar snugly engaging and circumscribing the juncture between the ski boot upper 14 and the sole region thereof. In this fashion, not only does the protector assembly militate against the ingress of foreign material when the protector is worn, but it also provides for a sure and positive fit and retention of the protector assembly while, at the same time, incorporating such a cooperative relationship with the ski boot as permits the ready removal and donning of the protector assembly. The protector assemblies being small and consequently of light weight are easily carried about by the user for use at any time that the ski boots are not engaged with the skiis and their bindings. Thus, the user may positively assure that his expensive ski boots are not prematurely damaged and also to assure that proper fit of the boots with the bindings and proper release of the boots may occur when necessary as for example during a fall.

What is claimed is:

1. A ski boot protector for preserving the integrity of the ski binding-engaging surfaces of a ski boot when the ski boot is not engaged with a binding, said protector being formed of elastic material and comprising:

an elongate sole protector portion sized to conform generally to the shape and plan view area of a ski boot sole;

forward and rear upstanding end wall members extending upwardly from said protector portion at the opposite ends thereof and each end wall member presenting an inner surface adapted to engage the forward and rear projecting ends of a ski boot sole, each end wall member extending from side-to-side of said sole protector portion and each having a cover flange likewise extending from side-to-side of said sole protector portion, the cover flanges being dimensioned to overlie and substantially to cover the projecting forward and rear ends of a ski boot sole; and an upstanding side wall member extending along each side of said sole protector portion and integrally joining said end wall members, said side wall members being spaced apart closely to engage along opposite sides of a ski boot.

2. A ski boot protector as defined in claim 1 wherein each side wall member terminates at the level of said cover flanges to present a narrow edge along each side of a ski boot.

3. A ski boot protector as defined in claim 2 wherein said protector portion comprises an intermediate section and opposite end sections, the intermediate section being of rectangular plan view and of substantially uniform thickness whereas each end section is of diminishing thickness from said intermediate section, whereby to allow a rocking action with respect to a supporting surface.

4. A ski boot protector as defined in claim 1 wherein said protector portion comprises an intermediate section and opposite end sections, the intermediate section being of rectangular plan view and of substantially uniform thickness whereas each end section is of diminishing thickness from said intermediate section, whereby to allow a rocking action with respect to a supporting surface.

5. A ski boot protector as defined in claim 3 wherein the bottom surface of said intermediate section is provided with a gripping tread pattern.

6. A ski boot protector as defined in claim 5 wherein the bottom surfaces of said end sections are also provided with gripping tread patterns.

7. A ski boot sole covering assembly comprising a slip-on type cover formed of elastic material and adapted snugly to engage the sole region of a ski boot while forming a collar embracing the juncture of the boot upper and the sole region thereof, said assembly comprising a sole member and integral upstanding walls circumscribing said sole member, and a pair of cover flanges joining upper edge portions of said walls at the toe and heel of said sole member, said flanges having inner edges which cooperate with the upper edges of said walls to define an opening which is adapted snugly to collar the juncture of a ski boot upper with the sole region thereof, the upper surface of said sole member being flat in order to engage in face-to-face contact with the bottom of a ski boot sole and the sole member having toe and heel sections which are of diminishing thicknesses toward the toe and heel ends thereof so as to allow rocking action when the assembly is worn on a ski boot.

* * * * *